US006591913B2

(12) United States Patent
Reaux et al.

(10) Patent No.: US 6,591,913 B2
(45) Date of Patent: Jul. 15, 2003

(54) SYSTEM AND METHOD FOR LESSENING IMPACT ON CHRISTMAS TREES DURING DOWNHOLE OPERATIONS INVOLVING CHRISTMAS TREES

(75) Inventors: James R. Reaux, Brookshire, TX (US); Dan T. Benson, Tomball, TX (US); Donald L. Thorne, New Iberia, LA (US)

(73) Assignee: Oceaneering International, Inc., Houston, TX (US)

( * ) Notice: Subject to any disclaimer, the term of this patent is extended or adjusted under 35 U.S.C. 154(b) by 22 days.

(21) Appl. No.: 10/015,418

(22) Filed: Dec. 12, 2001

(65) Prior Publication Data

US 2003/0106692 A1 Jun. 12, 2003

(51) Int. Cl.[7] ..... E21B 29/12

(52) U.S. Cl. ..... 166/352; 166/341; 166/90.1; 166/77.51

(58) Field of Search ..... 166/338, 339, 166/351, 353, 341, 80.1, 90.1, 77.51

(56) References Cited

U.S. PATENT DOCUMENTS

| | | | | | |
|---|---|---|---|---|---|
| 1,586,923 | A | * | 6/1926 | Townsend | 166/77.4 |
| 1,895,132 | A | * | 1/1933 | Minor | 166/77.4 |
| 1,984,230 | A | * | 12/1934 | Otis | 166/74 |
| 2,555,145 | A | * | 5/1951 | McKinney | 254/29 R |
| 4,023,814 | A | | 5/1977 | Pitts | |
| 4,062,406 | A | * | 12/1977 | Akkerman et al. | 166/323 |
| 4,076,079 | A | * | 2/1978 | Herricks et al. | 166/308 |
| 4,111,261 | A | * | 9/1978 | Oliver | 166/90.1 |
| 4,130,166 | A | * | 12/1978 | Akkerman et al. | 166/324 |
| 4,241,786 | A | | 12/1980 | Bullen | |
| 4,632,183 | A | | 12/1986 | McLeod | |
| 4,665,982 | A | * | 5/1987 | Brown | 166/308 |
| 4,685,521 | A | * | 8/1987 | Raulins | 166/341 |
| 4,723,215 | A | * | 2/1988 | Hibino et al. | 701/123 |
| 4,730,677 | A | * | 3/1988 | Pearce et al. | 166/345 |
| 4,867,243 | A | * | 9/1989 | Garner et al. | 166/379 |
| 4,991,650 | A | * | 2/1991 | McLeod | 166/72 |
| 4,993,492 | A | * | 2/1991 | Cressey et al. | 166/339 |
| 5,012,865 | A | * | 5/1991 | McLeod | 166/90.1 |
| 5,396,956 | A | * | 3/1995 | Cherewyk et al. | 166/250.08 |
| 5,785,121 | A | * | 7/1998 | Dallas | 166/90.1 |
| 5,975,211 | A | * | 11/1999 | Harris | 166/379 |
| 6,179,053 | B1 | * | 1/2001 | Dallas | 166/77.51 |
| 6,470,965 | B1 | * | 10/2002 | Winzer | 166/77.4 |
| 2002/0139535 | A1 | * | 10/2002 | Nice et al. | 166/344 |

FOREIGN PATENT DOCUMENTS

| | | | |
|---|---|---|---|
| WO | 98/38411 | * | 9/1998 |

* cited by examiner

*Primary Examiner*—Thomas B. Will
*Assistant Examiner*—Thomas A. Boach
(74) *Attorney, Agent, or Firm*—Duane Morris LLP

(57) ABSTRACT

A system and method for lessening impact on Christmas trees during downhole operations involving Christmas trees, by way of example and not limitation such as cementing processes. The system comprises an outer housing defining a chamber, a lubricator assembly disposed in the outer housing, and an inner sleeve slidably disposable within the chamber. The method uses the system of the present invention by inserting the inner sleeve into the lubricator assembly; lowering the inner sleeve into the Christmas tree to a predetermined position extending into a tubing hanger associated with the tree; introducing fluids through a fluid line coupled to the lubricator assembly, the fluids passing through a conduit within the inner sleeve into the wellbore; and retrieving the lubricator assembly upon completion of fluid introduction into the wellbore. In alternative embodiments, the inner sleeve may be retracted and withdrawn with the lubricator assembly upon completion of fluid introduction into the wellbore.

16 Claims, 2 Drawing Sheets

SYSTEM AND METHOD FOR LESSENING IMPACT ON CHRISTMAS TREES DURING DOWNHOLE OPERATIONS INVOLVING CHRISTMAS TREES

BACKGROUND OF THE INVENTION

1. Field of the Invention

The present invention relates to the field of downhole operations involving a Christmas tree. More specifically, the present invention, in an exemplary embodiment, relates to a system and method of operation using a tree saver with Christmas trees. More specifically still, the present invention, in an exemplary embodiment, relates to a system and method of operation using a tree saver with Christmas trees located subsea.

2. Description of the Related Art

Christmas trees are well known in the prior art, including use in subsea production of oil and gas, and are used in undersea operations to seal and control a well. Christmas trees typically have a series of pipes and valves that are situated on the well head after drilling of the well has been completed, and often extend vertically from the well head. Typically, the Christmas tree is coupled at its lower end to the well casing and (at least usually) to a string of tubing within the casing. Christmas tree assemblies further typically have one or more horizontal production outlets.

A tree saver is typically a heavy gauge piece of pipe which in some embodiments may be approximately two meters long and five centimeters in diameter and which is inserted through the Christmas tree and into the well tubing to prevent fracturing fluid from wearing away at the valves and parts of the Christmas tree. The tree saver may be held in place by means of a bolted coupling and rubber sleeve or by pressure in the well.

U.S. Pat. No. 4,632,183 issued to McLeod for an "INSERTION DRIVE SYSTEM FOR TREE SAVERS" is illustrative and discloses an insertion drive system for a well head tree saver that includes a pair of parallel, spaced beams, a lower one of which is attached to the tree. High pressure tubing is held by the upper beam and is inserted into or withdrawn from the tree by motor driven mechanical jack assemblies which lower or raise the upper beam relative to the lower beam. As motor means rotates the shafts the interaction between the upper ends of the shafts and the captive nuts cause the upper beam and its supporting apparatus to move downwardly to insert the tube through the Christmas tree. In the embodiments disclosed, once the tube has been lowered to its desired position a lock ring threadably engages a screw collar to lock the tree saver mandrel tube in place. There is no suggestion, motivation, or teaching to use pressure to lower the tree saver mandrel tube into place or to position the tree saver mandrel tube into a predetermined position extending into a tubing hanger associated with the tree.

U.S. Pat. No. 4,023,814 issued to Pitts for "TREE SAVER PACKER CUP" is also illustrative and discloses a packer cup assembly which attaches to the lower end of the mandrel in the tree saver which is itself attached to a Christmas Tree of a well head or the like. The assembly is tubular in configuration and comprises a metal part with internal threads at one end and a thinner walled part at its other end. The outer diameter of the lower end of the metal part is less than the outer diameter of the threaded end part in order to permit an elastomeric sleeve to fit over and extend beyond the reduced diameter end part of the metal part. The outer end of the elastomeric sleeve is flared outwardly and then tapered inwardly to facilitate entry into a string of tubing or the like. The other end of the elastomeric sleeve is bonded to the outer surface of the metal part. There is no suggestion, motivation, or teaching to use pressure to lower a tree saver into place or to position the tree saver into a predetermined position extending into a tubing hanger associated with the tree.

In the prior art, certain processes, by way of example and not limitation including cementing processes, are often used to plug a well once the well is no longer to be in service. It is desirable to be able to salvage, refurbish, and reuse subsea wellheads and Christmas trees. However, contaminants such as cement can get into the Christmas tree, fouling the Christmas tree and making it unsuitable for further use.

As is well known in the art, tree savers are used to protect the wellhead from pressure and, in the case of fracturing operations, from fracturing fluids. However, in the prior art, tree savers used during well completion processes provide no protection from cement getting into the Christmas tree, in part because Christmas trees were typically not salvaged. Alternatively, some prior art methods have to mobilize coil tubing to protect the tree, which typically increases overall costs.

U.S. Pat. No. 4,241,786 issued to Bullen for "WELL TREE SAVER" is illustrative and teaches a bypass attachment to prevent damage to the valves of a Christmas tree when fluid at high pressure is passed into a well, such as during a fracturing process. The bypass attachment is formed of a piston rod removably mounted to the well tree and offset from it, a piston mounted on the piston rod, a cylinder movable on the piston, the cylinder bearing a piece of high-pressure tubing aligned with the passage through the well-head tree, a high-pressure valve to close off the high-pressure tubing and sealing means to seal the space between the exterior of the high-pressure tubing and the interior of the vertical passage through the well-head tree. There is no suggestion, motivation, or teaching to use pressure to lower a tree saver into place or to position the tree saver into a predetermined position extending into a tubing hanger associated with the tree.

The prior art does not teach use of pressure to lower a tree saver into place or to position the tree saver into a predetermined position extending into a tubing hanger associated with the tree. Further, the prior art does not teach a tree saver that is wireline set and retrieved or pressure set and retrieved.

BRIEF DESCRIPTION OF THE DRAWINGS

These and other features, aspects, and advantages of the present invention will become more fully apparent from the following description, appended claims, and accompanying drawings in which:

DETAILED DESCRIPTION OF THE PREFERRED EMBODIMENT

The system and method of the present invention protect a Christmas tree from cement or other fluids used during a certain well processes by use of a tree saver that is wireline set and retrieved, pressure set and retrieved, or combinations thereof. In part, the method of the present invention substantially eliminates having to use coiled tubing which itself gives rise to other concerns. Use of wireline or pressure as in the present invention's method is typically the least cost method of well intervention.

Figure 1:
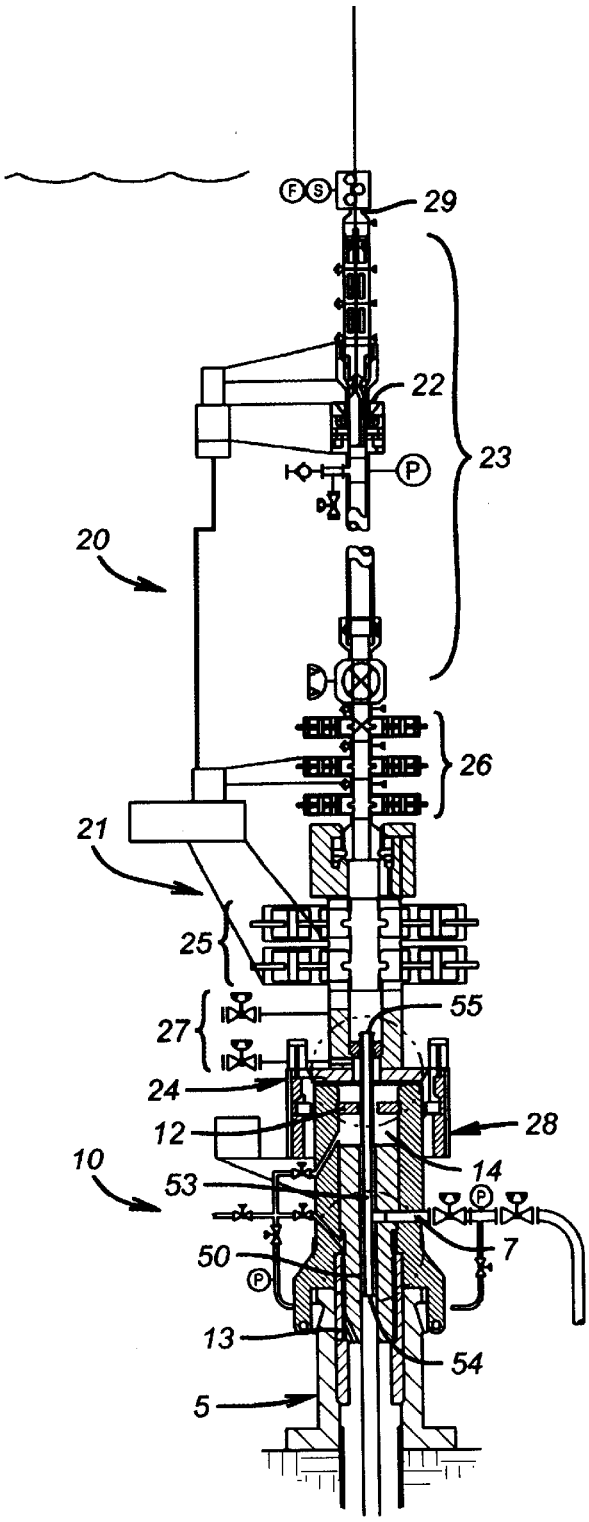
FIG. 1 is a partial cutaway planer view of an outer housing, lubricator assembly, and inner sleeve.

Referring to a partial cutaway planar view of an embodiment of a device of the present invention in FIG. 1, when a tree saver is in a receptacle of a Christmas tree and the Christmas tree is shut-in, cement used during the process has no place to go except the formation when the cement is being pumped in. At times, the cement cannot go back up annulus 14 between a tree saver and tubing, creating a type of "dead" space. Additionally, during certain cementing processes, well fluids may be displaced by cement and the well fluids will be allowed to flow back through the tree saver such as via annulus 14.

Referring still to FIG. 1, Christmas tree 10 is connected to wellhead 5. Upper pressure cap 12 is positioned within tree 10 and may be capped such as with a removable cap or plug (not shown in the Figures). Tubing hanger 13 may be deployed within tree 10 and may also be capped with a removable cap or plug (not shown in the Figures).

In an exemplary embodiment, the tree saver device of the present inventions comprises a pressure containing outer housing 20, further comprising a lubricator assembly, and tree saver inner sleeve 50 deployable within outer housing 20. Outer housing 20 may have multiple segments, shown in FIG. 1 as upper segment 23 and lower segment 21. First end 24 of outer housing 20 is adapted for connection with a corresponding mating end of Christmas tree 10, as will be familiar to those of ordinary skill in the hydrocarbon well arts. In a preferred embodiment, at least a portion of second segment 23 of outer housing 20 is detachable and contains greasehead 22. Wireline 40, which may comprise a "slickline" or cable, as these terms will be familiar to those of ordinary skill in the hydrocarbon well arts, passes and seals through second segment 23.

Outer housing 20 may additionally have side ports 27 for circulating well fluids, well treating fluids, cement, and the like. In the currently preferred embodiment, receptacle 52, known in the art as a "seat," is located below the lowermost blowout prevention device ("BOP") 25. In an exemplary embodiment, receptacle 52 is typically placed into position prior to positioning the tree saver device of the present inventions.

Figure 1C:
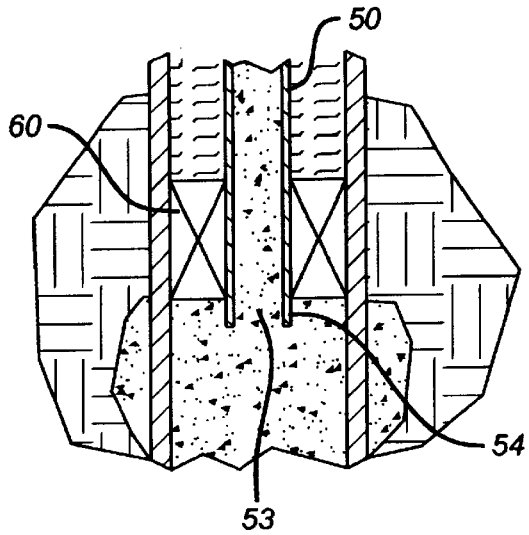
FIGS. 1*a* through 1*c* show the partial planer view of FIG. 1 in enlarged detail.
Figure 1A:
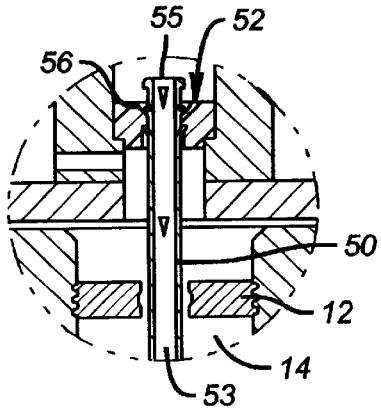

Referring additionally to FIG. 1*a*, inner sleeve 50 may be substantially tubular and slidably deployable within outer housing 20. Conduit 53 extends substantially through the length of inner sleeve 50 to allow passage of fluids through conduit 53 such as cement. In a preferred embodiment, inner sleeve 50 may be slidably mounted through receptacle 52. Second end 55 of inner sleeve 50 may further comprise seat 56 that may be adapted to seal against outer housing receptacle 20 when seated against receptacle 52. These seals may be made of a suitable elastomeric material as will be familiar to those in the art. Further, seat 56 may be of any appropriate type including an upset in end 55 of inner sleeve 50, O-rings, a-cup seals, and the like.

In currently envisioned embodiments, first end 54 of inner sleeve 50 may further have provisions for sealing in tubing hanger 13. By way of example and not limitation, U.S. Pat. No. 4,023,814 to Pitts is illustrative of a tubing hanger.

Figure 1B:
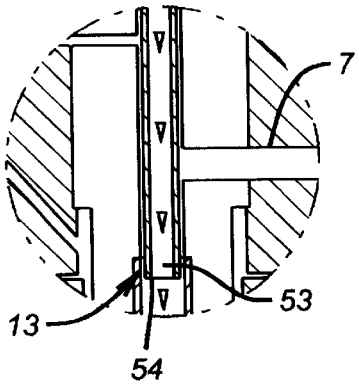

In the currently preferred embodiment, inner sleeve 50 may be slideably inserted into outer housing 20 with wireline 40 for operation using wireline 40. Referring additionally to FIG. 1*b*, by way of example and not limitation, in a currently preferred embodiment, inner sleeve 50 is seated in outer housing 20 using wireline 40 so that first end 54 of inner sleeve 50 projects into tree tubing hanger 13 below a tree production side port, e.g. 7. In a currently envision alternative embodiment, inner sleeve 50 may be slidably seated in outer housing 20 by use of differential pressure across inner sleeve 50 so that first end 54 of inner sleeve 50 projects into tree tubing hanger 13 below tree production side ports such as ports 7.

Referring additionally to FIG. 1*c*, when deployed, second end 54 of inner sleeve 50 protrudes into the wellbore, allowing fluid passage through conduit 53 into the wellbore. Inner sleeve 50 may be deployed with or through additional tools, by way of example and not limitation such as packer 60. In addition, other tools such as perforators may be deployed through inner sleeve 50.

Figure 2B:
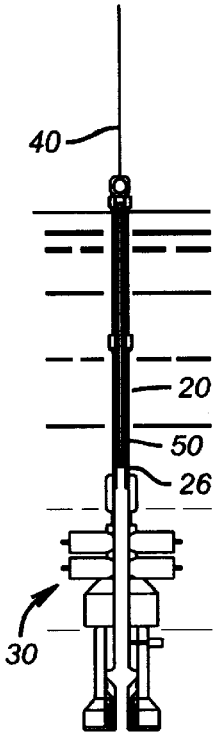
FIG. 2*a* and FIG. 2*b* are planar graphic representations of an exemplary system configuration of the present invention in a positioning mode.
Figure 2A:
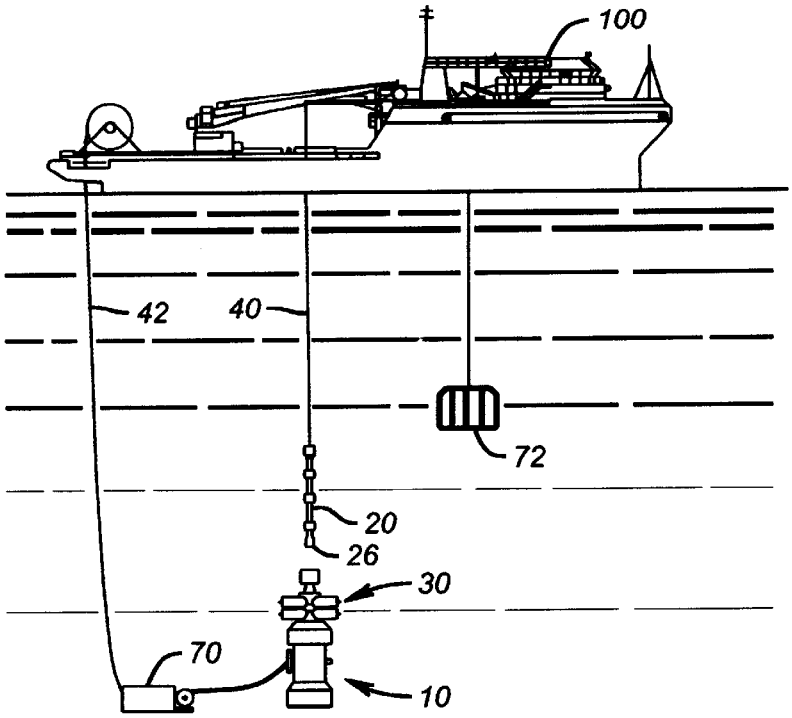

In the operation of an exemplary embodiment, referring to FIG. 2*a* and FIG. 2*b*, using the tree saver device of the present invention, fluids such as cement may be kept away from Christmas tree internals during passage of those fluids through the Christmas tree. For a completed undersea well having tree 10 located at wellhead 5, vessel 100 is positioned proximate the well. In the currently preferred embodiment, outer housing 20, comprising one or more segments such as subsea wireline lubricator assembly 23, is lowered, positioned, and then coupled to tree 10 by means that will be familiar to those of ordinary skill in the art. A subsea control unit may be operatively coupled to lubricator assembly 23. Pump 70 is lowered into position proximate the well, by way of example and not limitation such as use of control skid 72 adapted to operate sub-sea equipment either independently or with control directives issued from vessel 100, or is already deployed proximate the well. Pump 72 may also be operatively coupled to lubricator assembly 23 with control line 42 running back to vessel 100 from pump 70.

If a removable cap (not shown in the Figures) needs to be removed, after removing the removable cap, inner sleeve 50 is lowered from vessel 100 using wireline 40 passing through second end 29 of outer housing 20. In currently envisioned embodiments, inner sleeve 50 may be positioned proximate outer housing 20 using a remotely operated undersea vehicle (not shown in the Figures). As will be familiar to those of ordinary skill in the art, inner sleeve 50 may be attached to greasehead 22 for lowering into outer housing 20.

Figure 3B:
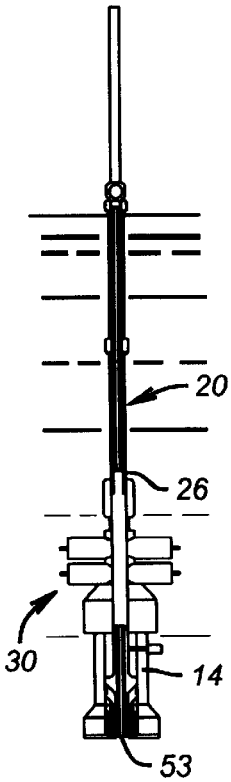
FIG. 3*a* and FIG. 3*b* are planar graphic representations of an exemplary system configuration of the present invention in a deployed mode.
Figure 3A:
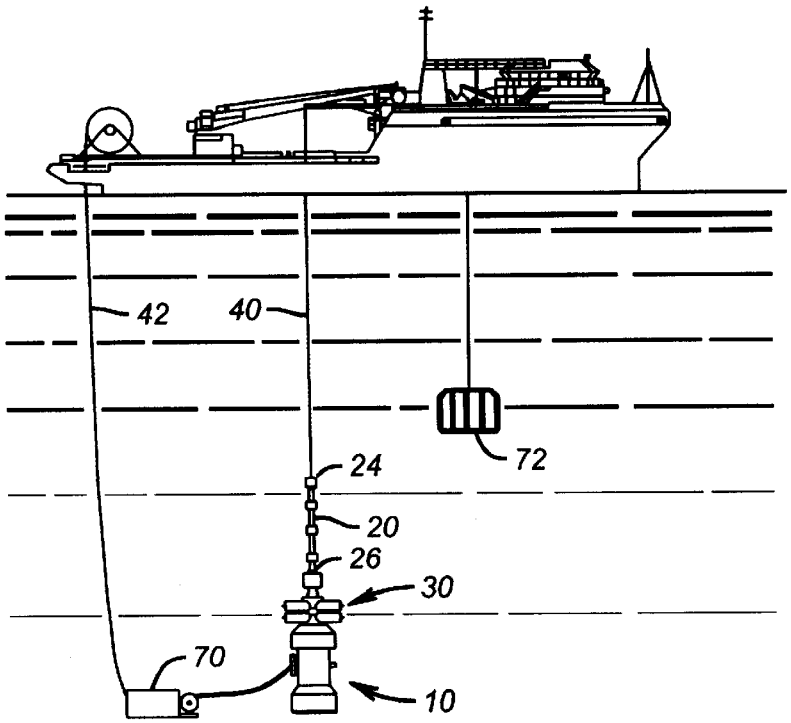

Referring to FIG. 3*a* and FIG. 3*b*, after outer housing 20 is attached to tree 10, inner sleeve 50 may be lowered through outer housing 20 into tree 10 and seated in outer housing 20 and tree 10 by methods familiar to those of ordinary skill in the art. In a preferred embodiment, inner sleeve 50 is inserted into tree 10 such as by using wireline 40. In an alternative embodiment, inner sleeve 50 may be inserted in tree 10 by pressure supplied by pump 70.

Once deployed into tree 10, inner sleeve 50 may extend from proximate a first opening in outer housing 20, e.g. proximate the intersection of outer housing 20 and tree 10, to a second position interior tubing hanger 13 that is past the tree production ports, e.g. 7, past the juncture between tree 10 and tubing hanger 13, and closely adjacent production tubing or into the production tubing. Once inner sleeve 50 is deployed into position, fluids, by way of example and not limitation such as cement, may be introduced into wellhead 5 through lubricator assembly 23, passing through conduit 53 in inner sleeve 50 and into wellhead 5.

When fluid operations, by way of example and not limitation such as cementing, are completed, inner sleeve 50 may remain deployed in first end 28 of outer housing 20 and may be removed with outer housing 20 such as to vessel 100. In an alternative embodiment, inner sleeve 50 may be retracted to second end 29 of outer housing 20 and may then be removed with outer housing 20 such as to vessel 100.

It will be understood that various changes in the details, materials, and arrangements of the parts which have been described and illustrated above in order to explain the nature of this invention may be made by those skilled in the art without departing from the principle and scope of the invention as recited in the following claims.

We claim:

1. A method of using an inner sleeve, slidably disposed within an outer housing adapted to connect to a Christmas tree located at a wellhead of a well located subsea, the outer housing further comprising a lubricator assembly, the inner sleeve further adapted to be displaceable within at least a portion of the Christmas tree, the inner sleeve further comprising a conduit through a predetermined length of the inner sleeve, the wellhead having a control line connected to the wellhead, the method comprising:

a. positioning a vessel proximate the wellhead;

b. lowering the outer housing to a position proximate the wellhead;

c. coupling the outer housing to the Christmas tree;

d. lowering the inner sleeve into a predetermined position within the outer housing, the position at least partially extending proximate a tubing hanger associated with the Christmas tree;

e. introducing fluids through a fluid line operatively in communication with the inner sleeve, the fluids passing through the conduit within the inner sleeve; and f. retrieving the outer housing upon completion of fluid introduction into the well.

2. The method of claim 1 wherein, once deployed into the Christmas tree, the inner sleeve extends from proximate a first opening in the Christmas tree to a predetermined second position in an interior of the well that is past the Christmas tree at the point of junction between the Christmas tree and the wellhead, whereby the inner sleeve extends from a lowermost blowout preventer past the Christmas tree and into a tubing hanger.

3. The method of claim 1 wherein the fluid comprises at least one of circulating well fluids, well treating fluids, and cement.

4. The method of claim 1 wherein step (f) further comprises:

i. retracting the inner sleeve into the outer housing upon completion of fluid introduction into the well; and ii. retrieving the inner sleeve concurrently with retrieving the outer housing.

5. The method of claim 1 wherein in step (d) further comprises lowering the inner sleeve from the vessel using a wireline.

6. The method of claim 1 wherein step (d) further comprises:

i. connecting a pump to the lubricator assembly with a fluid line; and ii. lowering the inner sleeve into the Christmas tree by using pressure supplied by the pump.

7. The method of claim 1 wherein step (d) further comprises lowering the inner sleeve into the tree by using a wireline.

8. The method of claim 1 wherein step (d) further comprises:

a. seating the inner sleeve in the outer housing;

b. positioning the inner sleeve into a predetermined position relative to the Christmas tree; and c. protecting tree internals from contaminants by using the inner sleeve.

9. The method of claim 1 wherein a wireline is used to set and retrieve the inner sleeve.

10. The method of claim 1 wherein pressure is used to set and retrieve the inner sleeve.

11. The method of claim 1 wherein, once deployed into the Christmas tree, the inner sleeve extends from proximate a first opening in the Christmas tree to a predetermined second position in an interior of the well that is past the Christmas tree at the point of junction between the Christmas tree and the wellhead, whereby the inner sleeve extends from a lowermost blowout prevention device past the Christmas tree and into a tubing hanger.

12. The method of claim 1 wherein the fluid comprises at least one of circulating well fluids, well treating fluids, and cement.

13. A tree saver system for operations involving subsea Christmas trees, comprising:

a. an outer housing having a first end and a second end, the outer housing defining a chamber therein;

b. a lubricator assembly disposed within the outer housing;

c. an inner sleeve slidably disposed within the chamber, the inner sleeve comprising an inner conduit; and d. a sleeve mover to move the sleeve the within the chamber to a predetermined position proximate a tubing hanger associated with the Christmas tree;

e. wherein i. the first end is adapted for coupling to a Christmas tree, and ii. the second end is adapted for receiving a line.

14. The system of claim 13 wherein the line comprises at least one of wirelines and flow lines.

15. The system of claim 13 wherein the inner sleeve is substantially tubular.

16. The system of claim 13 further comprising a seal disposed in an interior of the outer housing proximate the second end, the seal adapted to travel with the inner sleeve and seal against the outer housing.

* * * * *